US006607762B2

(12) United States Patent
Lazaris et al.

(10) Patent No.: US 6,607,762 B2
(45) Date of Patent: Aug. 19, 2003

(54) DISPOSABLE SINGLE SERVE BEVERAGE FILTER CARTRIDGE

(75) Inventors: Nicholas G. Lazaris, Newton, MA (US); Roderick H. Beaulieu, Cumberland, RI (US)

(73) Assignee: Keurig, Incorporated, Wakefield, MA (US)

( * ) Notice: Subject to any disclaimer, the term of this patent is extended or adjusted under 35 U.S.C. 154(b) by 11 days.

(21) Appl. No.: 09/782,665

(22) Filed: Feb. 13, 2001

(65) Prior Publication Data

US 2001/0048957 A1 Dec. 6, 2001

Related U.S. Application Data

(60) Provisional application No. 60/183,569, filed on Feb. 18, 2000.

(51) Int. Cl.[7] ..... B65B 29/02

(52) U.S. Cl. ..... 426/79; 426/113; 426/115; 426/433; 99/295; 99/317; 206/0.5; 206/222

(58) Field of Search ..... 99/293–295, 323, 99/317; 426/77, 79, 81, 433, 435, 106, 113, 115; 206/0.5, 219, 222

(56) References Cited

U.S. PATENT DOCUMENTS 5,300,308 A * 4/1994 Louridas ..... 426/112
5,325,765 A 7/1994 Sylvan et al. ..... 99/295
5,431,276 A * 7/1995 Lialin ..... 206/222
5,762,987 A * 6/1998 Fond et al. ..... 426/433
5,840,189 A 11/1998 Sylvan et al. ..... 210/474
5,899,137 A * 5/1999 Miller et al. ..... 99/295
6,007,853 A * 12/1999 Lesser ..... 426/77

* cited by examiner

*Primary Examiner*—Drew Becker
(74) *Attorney, Agent, or Firm*—Samuels Gauthier & Stevens

(57) ABSTRACT

A beverage filter cartridge comprises an outer container with an access opening. A filter element is received in and configured and arranged to subdivide the interior of the container into first and second chambers. A beverage medium is stored in the first chamber. A lid closes the access opening. The lid has a first section overlying the first chamber and a second section overlying the second chamber. The first section of the lid is yieldably piercable to accommodate an inflow of liquid into the first chamber for infusion with the beverage medium to produce a beverage. The filter element is permeable to accommodate a flow of the beverage from the first chamber into the second chamber, and the second section of the lid is yieldably piercable to accommodate an outflow of the beverage from the second chamber to the exterior of the cartridge.

10 Claims, 5 Drawing Sheets

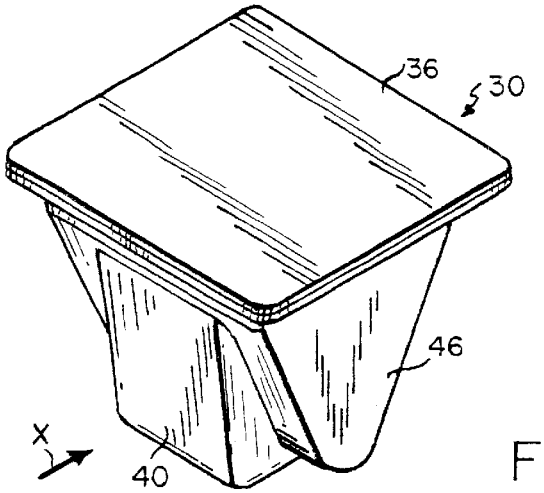
FIG. 6
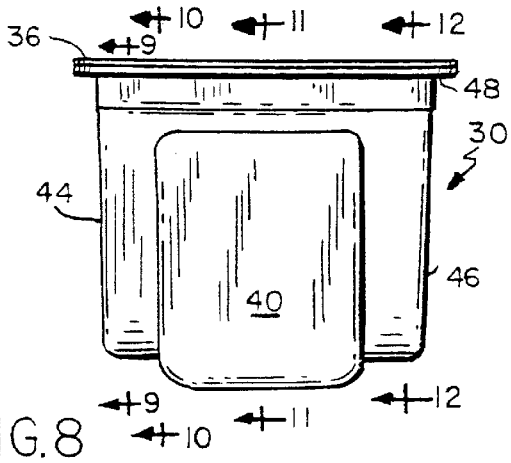
FIG. 8
FIG. 7
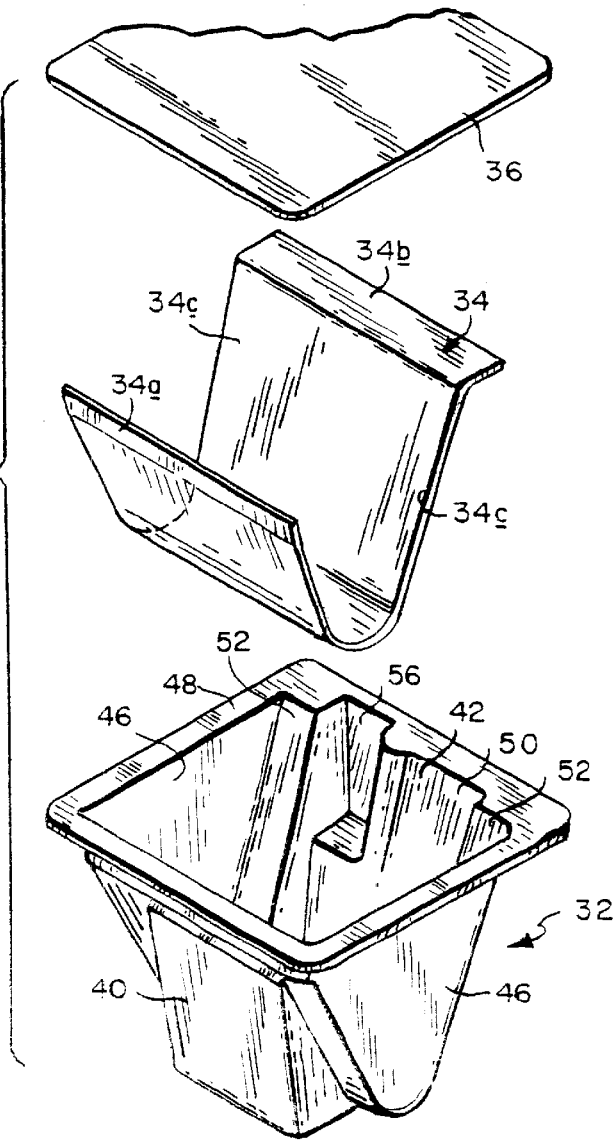

DISPOSABLE SINGLE SERVE BEVERAGE FILTER CARTRIDGE

CROSS REFERENCES TO RELATED APPLICATIONS

This application claims priority from Provisional Patent Application Serial No. 60/183,569 filed Feb. 18, 2000.

FIELD OF THE INVENTION

This invention relates to disposable single serve beverage filter cartridges.

DESCRIPTION OF THE PRIOR ART

A known disposable single serve beverage filter cartridge is disclosed in U.S. Pat. Nos. 5,325,765 and 5,840,189 (Sylvan et al), dated respectively Jul. 5, 1994 and Nov. 24, 1998. This beverage filter cartridge is comprised basically of an impermeable yieldably piercable cup-shaped container thermoformed or injection molded from a relatively rigid plastic material, and internally subdivided by a permeable cone-shaped filter into first and second chambers. A granular or powered dry beverage medium, e.g., roasted ground coffee, is stored in the first chamber, and the container is closed by an impermeable yieldably piercable lid comprising a laminate of metallic foil and plastic.

During a brewing cycle, the lid and container bottom are pierced from opposite directions, respectively, by tubular inlet and outlet probes. The inlet probe admits heated liquid into the first chamber for infusion with the beverage medium, and the resulting brewed beverage passes through the filter into the second chamber from which it exits via the outlet probe for delivery to an underlying cup.

This known beverage filter cartridge has gained rapid and increasingly widespread acceptance, notwithstanding certain problems and disadvantages relating to its use that have persisted since its initial introduction.

For example, as compared to the lid, the bottom of the cup-shaped container is relatively thick, with a higher resistance to piercing. The bottom cannot easily be thinned without adversely affecting the required thickness of the cup's sidewall to prevent permeability to oxygen and the ability to connect the filter material to the sidewall without damaging the oxygen barrier material. Thus, in the course of being punctured by the outlet probe, the bottom exhibits a tendency to distort inwardly, with an accompanying buckling of the container sidewall. Bottom distortion accompanied by sidewall buckling can adversely affect the puncturing process, resulting in leakage around the outlet probe.

A related problem stems from the need to equip the brewers with expensive metallic outlet probes that can be sharpened to the extent necessary to effect piercing of the more resistant container bottoms, and that can resist wear over prolonged periods of use.

Additionally, some of the brewed liquid beverage is not able to be evacuated because the outlet probe opening is above the bottom of the container and some of the beverage has no means of drainage.

What is needed, therefore, is an improved beverage filter cartridge that obviates or at least significantly minimizes the above-noted problems and disadvantages.

SUMMARY OF THE INVENTION

In accordance with the present invention, a beverage filter cartridge includes an impermeable outer container having an access opening. A planar filter element is configured and arranged to subdivide the container interior into first and second chambers. A beverage medium is stored in the first chamber and an impermeable lid closes the access opening.

The lid has a first section overlying the first chamber and a second section overlying the second chamber. The first and second lid sections are yieldably piercable, respectively, from the same direction, by single or multiple inlet and outlet probes. The inlet probe admits heated liquid into the first chamber for infusion with the beverage medium, and the resulting brewed beverage passes through the filter element into the second chamber, from which it exits via the outlet probe.

The lid material has a lesser resistance to being yieldably pierced as compared to the resistance of the container bottom, and is thus less prone to inward distortion with accompanying buckling of the container sidewall. The net result is a cleaner puncture and in improved seal around the outlet probe.

The relative ease with which the lid may be pierced also makes it possible to equip tie brewers with less expensive plastic inlet and outlet probes, in single or multiple configurations.

These and other features and advantages of the present invention will now be described in greater detail with reference to the accompanying drawings, wherein:

BRIEF DESCRIPTION OF THE DRAWINGS

FIG. 6 is a perspective view of another embodiment of a beverage filter cartridge in accordance with the present invention;

FIG. 7 is an exploded view of the basic components of the beverage filter cartridge shown in FIG. 6;

FIG. 8 is a side view of the beverage filter cartridge looking in the direction of arrow "X" in FIG. 6;

DETAILED DESCRIPTION OF ILLUSTRATED EMBODIMENTS

Referring initially to FIGS. 1–5, one embodiment of a beverage filter cartridge in accordance with the present invention is generally depicted at 10. The beverage filter cartridge includes an impermeable outer container 12, a permeable filter element 14, and an impermeable lid 16.

The outer container 12 is generally tray-shaped with a bottom wall 12*a*, a side wall 12*b* with a flat rim 12*c* surrounding an access opening 13, and a plurality of laterally spaced support ribs 12*d* projecting upwardly from the bottom wall and extending in parallel relationship in the lengthwise direction of the container.

Figure 1:
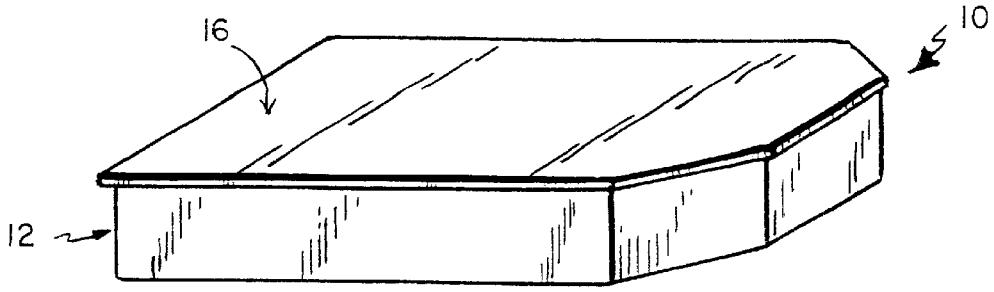
FIG. 1 is a perspective view of one embodiment of a beverage filter cartridge in accordance with the present invention.
Figure 2:
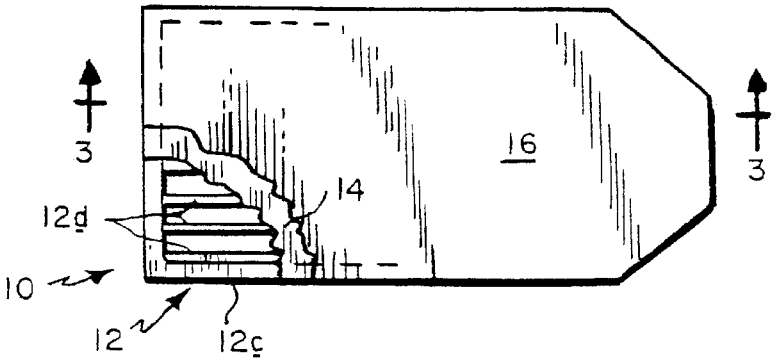
FIG. 2 is a top plan view of the beverage filter cartridge shown in FIG. 1, with portions of the lid and filter element broken away to illustrate details of the container interior.
Figure 3:
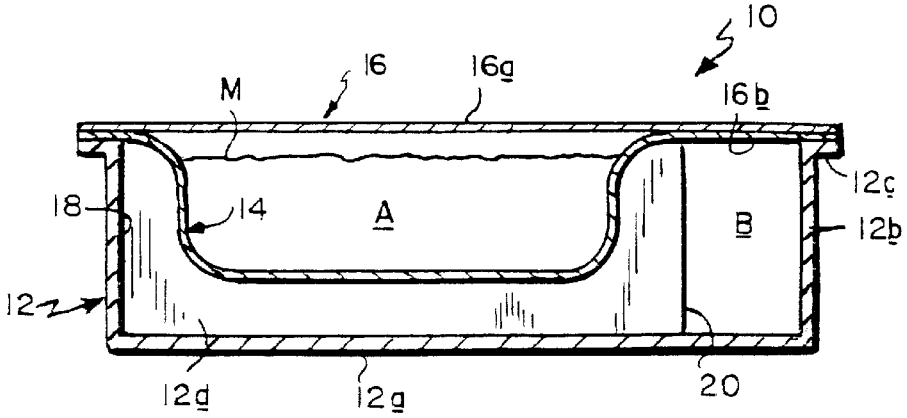
FIG. 3 is a sectional view on an enlarged scale taken along line 3—3 of FIG. 2.
Figure 4:
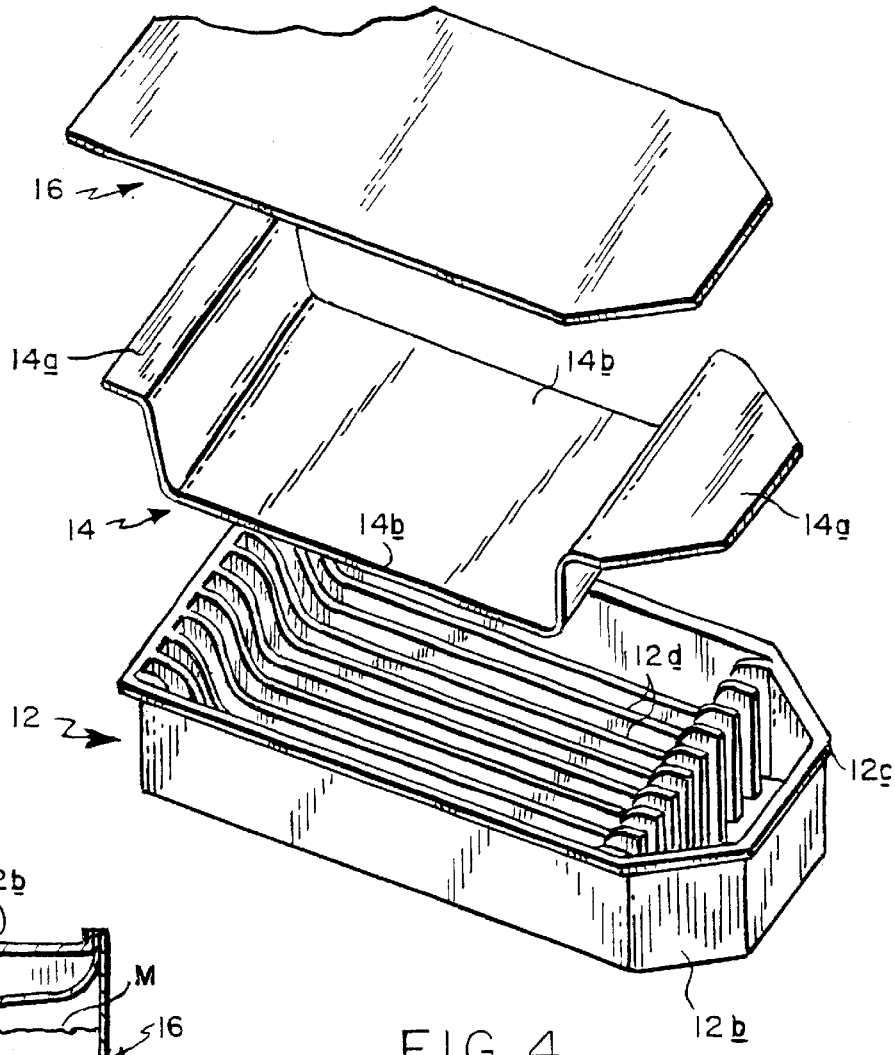
FIG. 4 is an exploded view of the basic components comprising the beverage filter cartridge shown in FIGS. 1–3.

As shown in FIG. 3, the ribs 12*d* join the sidewall 12*b* at 18, curve downwardly and then extend in parallel relationship to the bottom 12*a* before again curving upwardly to terminate as at 20.

The filter element 14 is formed from sheet material shaped to conform to the shape of the upper edges of the support ribs. The filter element is received in the container 12, with the edges 14*a* of its front and back ends overlapping and sealed to the rim 12*c* of the container side wall 12*b*, and with the edges 14*b* of its sides overlapping and sealed to outermost ribs 12*d* which are formed integrally with the container side wall. When thus positioned, the filter element defines a first chamber "A" separate from a second chamber "B", the latter being in communication with open channels separating the support ribs 12*d*.

A beverage medium "M", typically roasted ground coffee, is loaded into chamber A, after which the lid 16 is sealed to the rim 12*c* of the container wall 12*b* (and to any overlapping sealed edge portions of the filter). When thus positioned, the lid has a first section 16*a* overlying chamber A, and a second section 16*b* overlying chamber B.

The outer container may be formed, typically by injection molding, from an impermeable heat sealable material.

The filter element 14 may be cut or blanked from any suitably pliable, permeable and yieldably piercable sheet material, a preferred example being cellulose polypropylene supplied by J. P. Crompton, Ltd. of Bury, Lancashire, England. The lid may be cut or blanked from any suitable impermeable heat sealable and yieldably piercable material, a preferred example being a metallic/polymer laminate supplied by Heat Seal-Winpak, Ltd. of Montreal, Canada. The lid has less resistance to being yieldably pierced as compared to the outer container, which may or may not be yieldably piercable.

Figure 5:
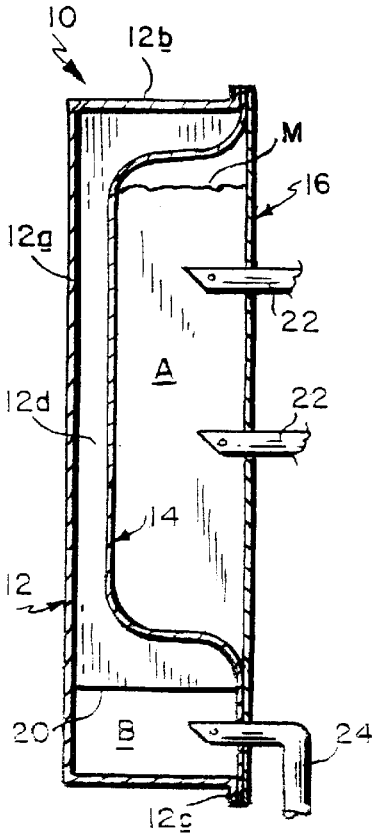
FIG. 5 is a cross sectional view similar to FIG. 3 showing the lid of the beverage filter cartridge punctured by inlet and outlet probes during a beverage brewing cycle.
Figure 9:
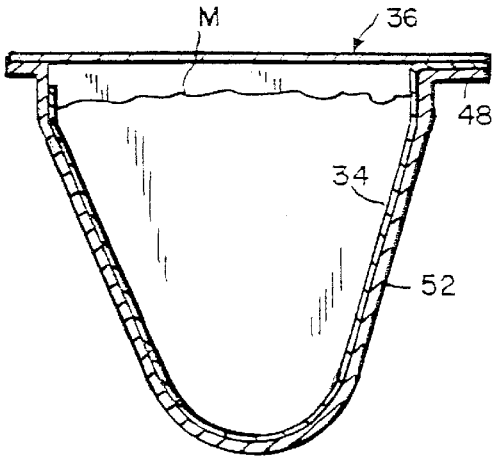
FIGS. 9, 10, 11 and 12 are sectional view on an enlarged scale taken respectively along lines 9—9, 10—10, 11—11 and 12—12 of FIG. 8.
Figure 10:
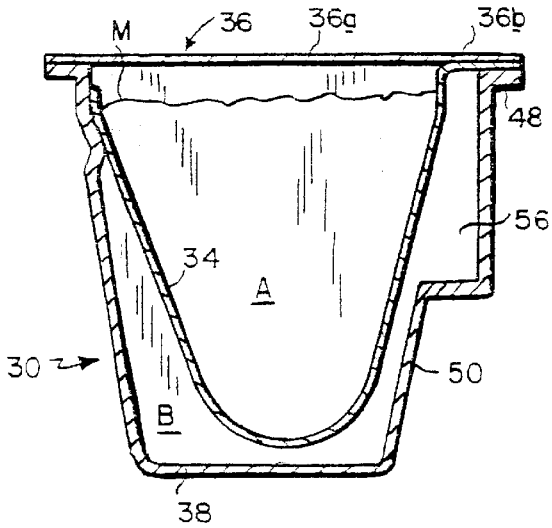
Figure 11:
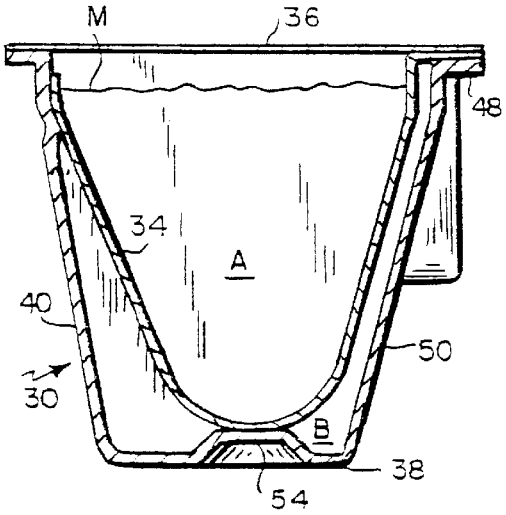
Figure 12:
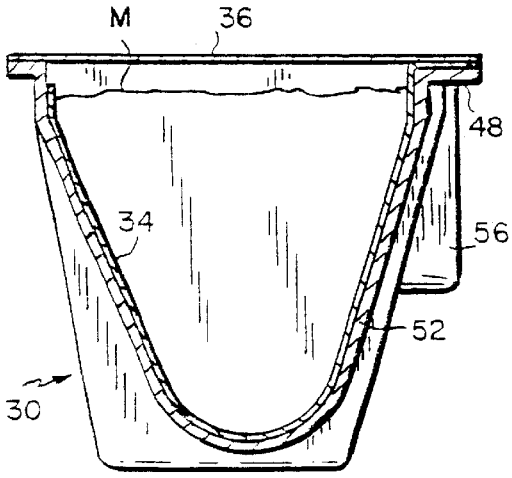

During a brewing cycle, as shown in FIG. 5, the cartridge can be oriented vertically, and the lid 16 is pierced with one or more tubular infusion probes 22 to admit hot water under pressure into chamber A for infusion with the beverage medium M. The resultant beverage passes through the filer element 14 into the channels defined between the support ribs 12*d*. From here, the beverage flows downwardly into chamber B from which it is extracted by one or more tubular exit probes 24 which pierce the lid and filter element at a location overlying chamber B. The probes 22, 24 are oriented in the same direction to operate on one side of the cartridge, without piercing the outer container. The soluble beverage medium is completely soaked because the rate of hot water being injected into the container is greater than the outflow rate provided by the outlet probes, resulting in the second chamber B becoming filled with beverage extract and forcing the first chamber A to become completely filled with hot water.

Although not shown, it will be understood that the cartridge may be oriented in other ways than as illustrated in FIG. 5 before, during or after the brewing process.

A second embodiment of a beverage filter cartridge in accordance with the present invention if generally depicted at 30 in FIGS. 6–13. The cartridge components are illustrated separately in FIG. 7, and include an outer container 32, a planar filer element 34, and a lid 36.

The container 32 has a bottom wall 38, a front wall 40, a back wall 42, and side walls 44, 46. The front, back and sidewalls extend upwardly from the bottom wall to a peripheral rim 48 surrounding an upper opening 50.

The side walls 44, 46 are appropriately contoured to define generally V-shaped ledges 52 extending between the front and back walls 40, 42, with the lower portions of the ledges 52 being spaced above the container bottom 38. The bottom 38 is preferably contoured to provide an upwardly protruding centrally located boss 54. The back wall 42 is contoured and the upper rim 48 is recessed to provide a well 56 opening towards the interior of the container.

The filter element 34 has front and back edge regions 34*a*, 34*b*, and side edge regions 34*c*. The filter element is configured, dimensioned and operatively positioned to subdivide the interior of the container into first and second chambers "A", "B", with the well 56 opening into and forming part of chamber B. When the filter element is thus positioned, it will be understood that its side edge regions 34*c* are secured as by heat sealing to the ledges 52 of the side walls 44, 46, and the front and back edge regions 34*a*, 34*b* are similarly secured to the front and back walls 40, 42. Preferably, the bottom of the filter element is also secured as by heat sealing to the upwardly protruding boss 54.

A beverage medium "M" is received through the upper opening 50 and stored in the first chamber A. The upper opening is then closed by securing the lid 36, as by heat sealing, to the peripheral container rim 48.

The outer container may be formed from impermeable heat sealable materials, a preferred example being polyethylene/EVOH/polystyrene supplied by Curwood Flexible Packaging of Oshkosh, Wis., U.S.A.

The materials from which the filter element 34 and lid 36 are formed may be the same as those described previously for the filter element 14 and lid 16 of the first embodiment.

The lid 36 has a first section 36*a* overlying chamber A, and a second section 36*b* overlying the well 56.

Figure 13:
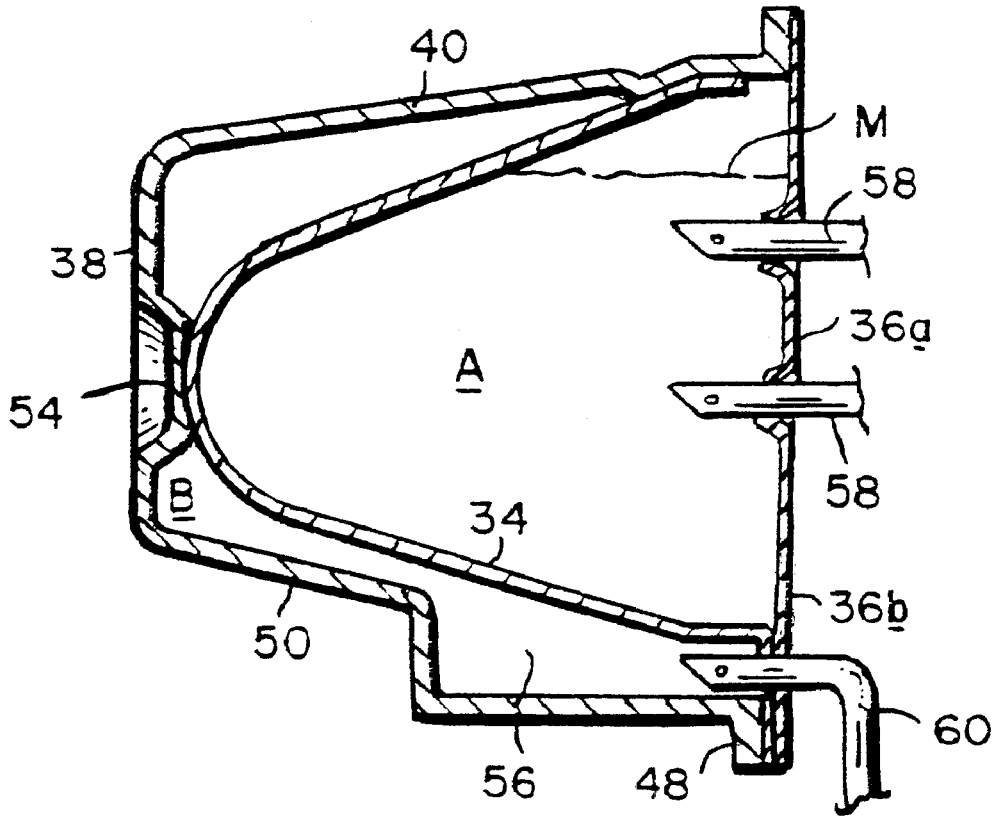
FIG. 13 is a sectional view similar to FIG. 10 showing the lid of the beverage filter cartridge punctured by inlet and outlet probes during a beverage brewing cycle.

As shown in FIG. 13, at the onset of a brewing cycle, the lid section 36*a* is pierced by one or more inlet probes 58, and the lid section 36*b* and underlying portion of the filter element are pierced by an outlet probe 60. The inlet probe admits heated liquid into chamber A for infusion with the beverage medium M, and the resulting brewed beverage passes through the filter element into chamber B from which it exits via the outlet probe 60.

It will thus be seen that in both embodiments, the outer container is not pierced. Rather, liquid communication is established with the separate chambers A, B by inlet and outlet probes operating from the same side of the cartridge to pierce different sections of the readily piercable lid.

Although the outer container and lid have been described as being formed from impermeable materials, it will be understood by those skilled in the art that, alternatively, permeable materials may be employed for one or both of these components. Where permeable materials are employed, the completed cartridges will preferably be subsequently enclosed, either individually or in batches, with impermeable wrappings. Materials for such wrappings are well known, and include for example EVOH films, aluminum foil, etc.

We claim:

1. A beverage filter cartridge comprising:

an outer container having an access opening:

a filter element received in and configured and arranged to subdivide the interior of said container into first and second chambers;

a soluble beverage medium stored in said first chamber; and a lid closing said access opening, said lid having a first section overlying said first chamber and a second section overlying said second chamber, the first section of said lid being piercable to accommodate an inflow of liquid into said first chamber for infusion with the beverage medium to produce a beverage, said filter element being permeable to liquid to accommodate a flow of the beverage from said first chamber into said second chamber, and the second section of said lid being piercable to accommodate an outflow of the beverage from said second chamber to the exterior of said cartridge.

2. The beverage filter cartridge of claim 1 wherein said lid has less resistance to being pierced as compared to the resistance to piercing of said container.

3. The beverage filter cartridge of claim 1 wherein said filter element is piercable.

4. The beverage filter cartridge of claim 1 wherein a first section of said filter element coacts with interior surfaces of said container to define said first chamber, and a second section of said filter element underlies the second section of said lid.

5. The beverage filter cartridge of claim 1 wherein said container is provided with a flat rim surrounding and projecting outwardly from said access opening, and wherein edge segments of said filter element overlap and are heat sealed to segments of said rim.

6. The beverage fitter cartridge of claim 4 wherein the second sections of both said lid and said filter element are piercable to accommodate the beverage outflow from said second chamber.

7. The beverage filter cartridge of claim 1 wherein said filter element comprises a planar sheet of permeable piercable material.

8. The beverage filter cartridge of claim 1 wherein said outer container is impermeable to liquids and gases.

9. The beverage filter cartridge of claim 1 or 8 wherein said lid is impermeable to liquids and gases.

10. A beverage filter cartridge comprising:

an outer container having a access opening;

a planar filter element received in and configured and arranged to subdivide the interior of said container into first and second chambers;

a soluble beverage medium stored in said first chamber; and a lid closing said access opening, said lid and said outer container being impermeable to liquids and gases, said lid having first section overlying said first chamber and a second section overlying said second chamber, the first section of said lid being piercable to accommodate an inflow of liquid into said first chamber for infusion with the beverage medium to produce a beverage, said filter element being permeable to liquid to accommodate a flow of the beverage from said first chamber into said second chamber, and the and section of said lid being piercable to accommodate an outflow of the beverage from said second chamber to the exterior of said cartridge, said lid having less resistance to being pierced as compared to the resistance to piercing of said container.

* * * * *